US006807380B2

(12) United States Patent
Iida et al.

(10) Patent No.: US 6,807,380 B2
(45) Date of Patent: Oct. 19, 2004

(54) WIRELESS COMMUNICATION SYSTEM AND IMAGE FORMING DEVICE

(75) Inventors: Atsushi Iida, Iwatsuki (JP); Kanou Saitou, Iwatsuki (JP); Hiroyuki Sakai, Iwatsuki (JP)

(73) Assignee: Fuji Xerox Co., Ltd., Tokyo (JP)

( * ) Notice: Subject to any disclaimer, the term of this patent is extended or adjusted under 35 U.S.C. 154(b) by 49 days.

(21) Appl. No.: 10/227,464

(22) Filed: Aug. 26, 2002

(65) Prior Publication Data

US 2003/0180059 A1 Sep. 25, 2003

(30) Foreign Application Priority Data

Mar. 19, 2002 (JP) ..... 2002-075837

(51) Int. Cl.[7] ..... G03G 15/00
(52) U.S. Cl. ..... 399/12; 399/13
(58) Field of Search ..... 399/12, 13, 27

(56) References Cited

U.S. PATENT DOCUMENTS 4,961,088 A * 10/1990 Gilliland et al. ..... 399/12
4,963,939 A * 10/1990 Kurando et al. ..... 399/12
6,144,812 A * 11/2000 Ueno ..... 399/12
6,381,419 B1 * 4/2002 Kinoshita et al. ..... 399/27
6,385,407 B1 * 5/2002 Inose ..... 399/12
6,404,995 B1 * 6/2002 Kimizuka ..... 399/13
6,490,422 B2 * 12/2002 Harumoto ..... 399/12

FOREIGN PATENT DOCUMENTS

JP 2001-22230 1/2001

* cited by examiner

*Primary Examiner*—Fred L Braun
(74) *Attorney, Agent, or Firm*—Morgan, Lewis & Bockius, LLP

(57) ABSTRACT

Tag side antennas attached at cartridge accessories and main body side antennas can be disposed sufficiently close to one another and facing one another without an increase in size of a device, even if the tag side antennas cannot be attached so as to cover end surface portions of the cartridge accessories and/or the number of the cartridge accessories mounted at the device main body is large. Tag side antennas disposed at each of toner cartridges are formed by conductive wiring in coil shapes. The toner cartridges are supported such that axes of these coils are substantially orthogonal to an insertion/removal direction at a cartridge holder. A main body side antenna is also formed by conductive wiring in a coil shape, has a coil axis substantially orthogonal to the insertion/removal direction, and may be supported interposed in a space between two of the toner cartridges.

7 Claims, 10 Drawing Sheets

40
44
68
78
45
60
50
53
52
S
80
53
90
66
72
45
TC
94
86
92
82
88
84
124
BC
120
122
TC
84
44
82
72
68B
92
88
86
94
50
90
52
42
D

WIRELESS COMMUNICATION SYSTEM AND IMAGE FORMING DEVICE

BACKGROUND OF THE INVENTION

1. Field of the Invention

The present invention relates to a wireless communication system for use in various devices in which a plurality of cartridge accessories are detachably mounted at a device main body, and relates to an image forming device for a copier, facsimile machine, printer or the like in which a plurality of cartridge accessories are detachably mounted at a main body of the device.

2. Description of the Related Art

In order to facilitate maintenance in image forming devices such as copiers that use electrophotography processes, laser printers and the like, containers that accommodate toner are structured as toner cartridges. A toner cartridge is a cartridge accessory which is detachably mounted at a device main body. In such image forming devices, when all of the toner has been discharged from inside the toner cartridge, a user resupplies toner by replacing the toner cartridge with a new toner cartridge. At this time, the used toner cartridge which has been removed from the image forming device is often returned from the user to a maker of the image forming device. The maker carries out a recycling process of inspection, cleaning, replacement of consumable components, refilling with toner and the like, and then ships the cartridge back to users. If the aforementioned image forming device is a device for forming color images, a plurality of toner cartridges are mounted at the device main body (for example, four toner cartridges, corresponding to black, cyan, magenta and yellow), and these cartridges supply toners of mutually different colors to a device main body side.

As process accessories relating to an image-making process in an image forming device as described above, there may be provided: a developer unit which causes toner to adhere to an electrophotography light-sensitive body (hereinafter referred to simply as "light-sensitive body"); a cleaning unit which, after a toner image has been transferred from the light-sensitive body, retrieves remaining toner; a charging unit for charging an image-bearing surface of the light-sensitive body to a predetermined potential; and the like. At least one of these process accessories is provided with a cartridge accessory that is integrally supported together with the light-sensitive body, known as a "process cartridge". When an endurance lifetime of any of various components that constitute the process cartridge has passed, the process cartridge is replaced with a new process cartridge. Such process cartridges are also often returned from the user to the maker. The maker performs a recycling process on the process cartridge, including inspection, cleaning, replacement of components that have exceeded their lifetimes, and the like. The maker then ships the process cartridge back to users for use in image forming devices.

In recent years, tags (wireless communication tags) that include electromagnetic communication functions and information storage functions have been attached at each of cartridge accessories in such image forming devices, that is, at toner cartridges, process cartridges and the like. A wireless communication device is disposed at a device main body side for performing input and output of information to and from such wireless communication tags. In this kind of image forming device, when the cartridge accessory is mounted at the device main body, a main body control section provided at the device main body can read information stored at the tag of the cartridge and/or write information to the cartridge tag by electromagnetic communication between the wireless communication device and the cartridge tag. Thus, for example, the main body control section can read information corresponding to the type of the cartridge accessory from the cartridge tag. Thus, if a cartridge accessory of a type different from a type of cartridge accessory that should be mounted is erroneously mounted at a mounting section at the device main body, this erroneous mounting of the cartridge accessory can be detected and control for necessary error processing and the like can be performed. Further, the main body control section may write a usage history of the cartridge accessory to the wireless communication tag, based on the number of images formed and the like. Subsequently, information relating to the usage history may be read, by the maker or the like, from the wireless communication tag of a cartridge that has been returned from a user. Hence, inspection work, component replacement work and the like of the recycling process can be performed more efficiently and accurately.

When a wireless communication tag attached to a cartridge accessory as described above is performing wireless communication, information processing or the like, the tag consumes electric power. The electric power may be supplied from the wireless communication device at the device main body side by electromagnetic induction. Thus, there is no need to include batteries or the like as a power source, and this is preferable in view of size reduction and cost control. In this kind of wireless communication tag, a non-volatile memory such as an EEPROM or the like may be used as an information storage element, and thus information can be constantly retained without consumption of electricity.

An example of such an image forming device equipped with a wireless communication tag to which electricity is supplied by electromagnetic induction is disclosed in Japanese Patent Application Laid-Open (JP-A) No. 2001-22230. In this image forming device a wireless communication tag is attached at each of a process cartridge and a developer cartridge, which is a cartridge accessory for a developing unit, and a wireless communication device is provided at a device main body side. A transceiver antenna is provided at each of the wireless communication tags and the wireless communication device. Each transceiver antenna is formed with a metallic film wound into a coil shape. The transceiver antennas of the wireless communication tags are respectively provided at outer side end surface portions along attachment/detachment directions of the process cartridge and the developer cartridge. The transceiver antenna of the wireless communication device is disposed at an inside surface of a device front face door, so as to oppose the end surface portions of the process cartridge and the developer cartridge with small gaps therebetween when the door is closed. Viewed from an axial direction of the cartridges, the transceiver antenna of the wireless communication device covers the end surface portions of the process cartridge and the developer cartridge, and has a large area in directions orthogonal to the axial direction. Therefore, electromagnetic induction to the two transceiver antennas of the cartridges by the single antenna transceiver of the wireless communication device is possible. Here, the electricity supplied to the wireless communication tags by electromagnetic induction is weak. However, because the transceiver antennas of the wireless communication tags and the device main body side transceiver antenna are sufficiently close to each other, electromagnetic communication between the wireless communication tags and the wireless communication device of the device main body can be adequately performed.

However, in a cartridge accessory for mounting at such an image forming device, a number of structures and components may have to be disposed at the end surface portion along the direction of attachment/detachment to the device main body. In some cases, so as to avoid impeding these structures and components, a wireless communication tag in which a transceiver antenna is included so as to cover the end surface portion of the cartridge accessory can not be attached to the cartridge accessory. Further, it may be necessary to provide a number of structures and components at a portion of the device main body side that opposes the end surface portion of the cartridge accessory, in correspondence to the structure of the cartridge accessory. In order to avoid impeding these structures and accessories, there are cases in which the transceiver antenna (that is, the tag side antenna) cannot be disposed thereat.

Moreover, if the wireless communication tags are attached at the end surface portions of the cartridge accessories, then, as the number of cartridge accessories mounted at the device main body increases, the transceiver antenna disposed at the device main body must increase in size, or the number of transceiver antennas disposed thereat must increase. Therefore, in an image forming device in which the number of cartridge accessories is large, such as a color laser printer or the like, it is difficult to dispose the transceiver antenna (the main body side antenna) at the device main body such that the transceiver antenna is sufficiently close to and faces the cartridge accessory transceiver antennas (the tag side antennas), without the device becoming large.

SUMMARY OF THE INVENTION

In consideration of the situation described above, an object of the present invention is to provide a wireless communication system in which a main body side antenna and tag side antennas can be disposed sufficiently close to one another and facing one another, even when the tag side antennas cannot be attached at cartridge accessories so as to cover end surface portions thereof or when the number of cartridge accessories mounted at the device main body is large, and to provide an image forming device in which this wireless communication system is applied.

In order to achieve the above described object, a wireless communication system relating to the present invention is a wireless communication system provided at a device comprising a device main body and a plurality of cartridge accessories insertably and removably mounted at the device main body, the system comprising: at least one main body side antenna disposed at the device main body; and tag side antennas attached at the cartridge accessories, wherein the tag side antennas are supported by the cartridge accessories such that coil axes of the tag side antennas are substantially perpendicular to a direction of insertion and removal of the cartridge accessories into and from the device main body, and the main body side antenna is supported by the device main body such that a coil axis of the main body side antenna is substantially parallel with at least one of the coil axes of the tag side antennas.

Further, in order to achieve the above described object, a wireless communication system relating to the present invention is a wireless communication system to be used at a device, the device including a device main body, a plurality of cartridge attachment/detachment portions provided at the device main body, and the plurality of cartridge accessories which are respectively inserted at the cartridge attachment/detachment portions and are insertably and removably mounted thereat, the wireless communication system comprising: wireless communication tags attached at the cartridge accessories and each including a tag side antenna formed with a conductive member in a coil shape, a tag side wireless control section for transmitting and receiving information non-contactingly via the tag side antenna, and an information storage device for reading therefrom and writing thereto information in accordance with the tag side wireless control section; and a wireless communication device disposed at the device main body and including a main body side antenna formed with a conductive member in a coil shape, and a main body side wireless control section for inputting and outputting information to the tag side wireless control section non-contactingly via the main body side antenna and the tag side antenna, wherein the tag side antenna is supported by the cartridge accessory such that a coil axis of the tag side antenna is substantially perpendicular to a direction of insertion and removal of the cartridge accessory at the cartridge attachment/detachment portion, and the main body side antenna is disposed at the device main body such that a coil axis of the main body side antenna is substantially perpendicular to the direction of insertion and removal and such that the main body side antenna faces the tag side antenna.

In the wireless communication system relating to the present invention, the tag side antenna is supported by the cartridge accessory such that the coil axis of the tag side antenna substantially intersects (is substantially orthogonal to) an insertion/removal direction of the cartridge accessory with respect to a cartridge attachment/detachment portion. Hence, there is no need for the tag side antenna to be disposed so as to cover the end surface portion in the insertion/removal direction of the cartridge accessory. Thus, even if structures, components and the like are disposed at the end surface portion of the cartridge accessory, these structures, components and the like will not be impeded, and the wireless communication tag can be easily mounted at the cartridge accessory.

Further, in the wireless communication system relating to the present invention, the main body side antenna is disposed at the device main body such that the coil axis of the main body side antenna substantially intersects (is substantially orthogonal to) the insertion/removal direction, and such that the main body side antenna faces the tag side antenna along a coil axis orthogonal direction, which intersects the coil axis of the main body side antenna. Thus, there is no longer any need to dispose the main body side antenna at a portion opposing the end surface portion of the cartridge accessory in the device main body. Therefore, even if there are structures, components and the like disposed at the portion opposing the end surface portion of the cartridge accessory in the device main body, these structures, components and the like will not be impeded, and the main body side antenna can be easily disposed at the device main body.

Specifically, for example, the main body side antenna may be disposed in a space between a plurality of cartridge accessories in the device main body, or in a space between the device main body and an upper end portion or lower end portion of the cartridge accessories, or the like. Such spaces (dead spaces) have rarely been effectively used heretofore. The main body side antenna can easily be made to oppose the tag side antennas while being sufficiently close to the tag side antennas. Therefore, the main body side antenna can be disposed efficiently in space inside the device main body, and information communication can be reliably performed by electromagnetic waves between the wireless communication device and the wireless communication tags. In particular, if the main body side antenna is disposed between a plurality of cartridge accessories in the device main body, a front surface portion and a back surface portion of a single main body side antenna can be made to oppose different tag side antennas. Thus, even if the main body side antenna is made smaller, electromagnetic transmission and reception can be reliably performed between the single main body side antenna and the two tag side antennas.

Further, an image forming device relating to the present invention includes: a device main body that carries out image forming; a plurality of cartridge attachment portions provided at the device main body; a plurality of cartridge accessories insertably and removably mounted at the cartridge attachment portions; and a wireless communication system, which is the wireless communication system relating to the present invention.

Therefore, according to the image forming device relating to the present invention, as is clear from the foregoing explanation of the wireless communication system relating to the present invention, even if structures, components and the like are disposed at the end surface portion of the cartridge accessory, the wireless communication tag can easily be attached to the cartridge accessory so as not to impede these structures, components and the like. Moreover, even if structures, components and the like are disposed at a portion of the device main body that opposes the end surface portion of the cartridge accessory, the main body side antenna can easily be disposed at the device main body so as not to impede these structures, components and the like.

As a result, for example, the main body side antenna may be disposed in a space between a plurality of cartridge accessories in the device main body of the image forming device, in a space between the device main body and an upper end portion or lower end portion of the cartridge accessories, or the like. These spaces (dead spaces) have rarely been effectively used heretofore. Thus, the main body side antenna can easily be made to oppose the tag side antennas while being sufficiently close to the tag side antennas. Therefore, the main body side antenna can be disposed efficiently in the space inside the device main body, and electricity supply by electromagnetic induction and radio communication can be reliably performed between the wireless communication device and the wireless communication tags.

DESCRIPTION OF THE PREFERRED EMBODIMENT

Now, a laser printer relating to an embodiment of the present invention and a wireless communication system in the laser printer will be explained with reference to the drawings.

Structure of Laser Printer

Figure 1:
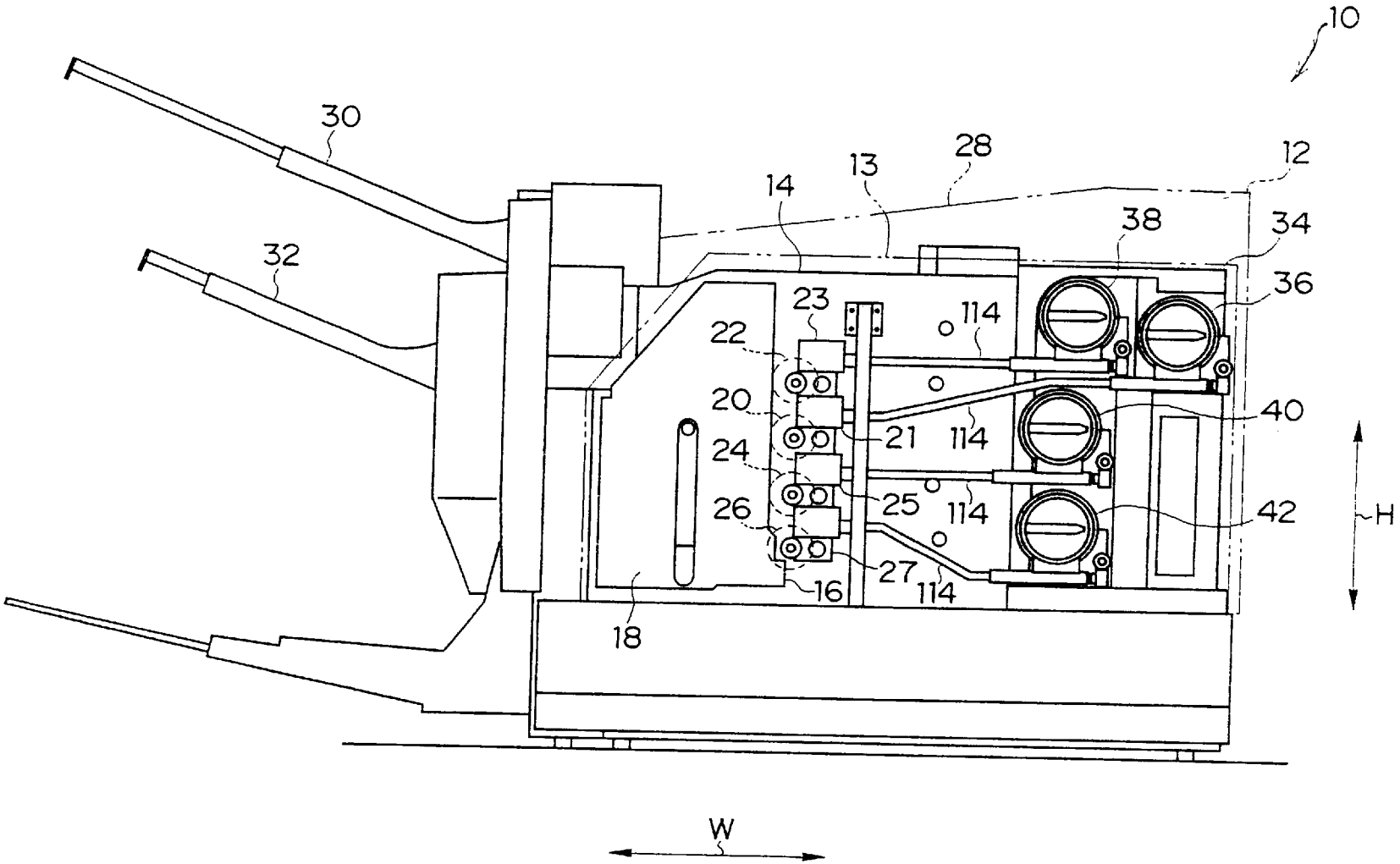
FIG. 1 is a side view showing structure of a laser printer relating to an embodiment of the present invention.

FIG. 1 shows a laser printer as an example of an image forming device relating to the embodiment of the present invention. This laser printer 10 forms images (toner images), on the basis of image information inputted from an external device, by a well-known electrophotography process. The images are recorded on recording paper or the like. Here, an electrophotography process means a process for recording an image on a recording material by a sequence of: charging an electrophotography light sensitive body; forming a static electricity latent image by laser scanning; developing the static electricity latent image to form a toner image on the electrophotography light-sensitive body; transferring this toner image to the recording material; and heating and fixing the transferred toner image. Because this electrophotography process and various components directly relating to the electrophotography process, such as the electrophotography light sensitive body, are not directly related to the substance of the present invention, detailed descriptions thereof are not provided herein. However, the laser printer 10 relating to the present embodiment is a laser printer capable of forming color images using magenta (M), yellow (Y), black (B) and cyan (C) toners.

A housing 12 is provided at the laser printer 10 as an outer casing portion of the device. In the housing 12, a main frame 14 is provided for supporting the various components that constitute the device. A process unit 16 is disposed at the main frame 14, at one end portion (the left end portion in FIG. 1) along a transverse direction of the device (the direction of arrow W). A slide frame 18 is provided at the process unit 16. The slide frame 18 is supported by the main frame 14 so as to be slideable along a depth direction of the device. Predetermined process accessories (not shown), such as an intermediate transfer belt, a transfer unit, a cleaning unit and the like, are mounted at the slide frame 18. Accordingly, it is expected that during maintenance the process unit can be pulled out from inside the main frame 14, and exchange, inspection and the like of the process accessories mounted at the slide frame 18 will be facilitated.

Four photosensitive drums 20, 22, 24 and 26 are supported at the main frame 14, adjacent to the process unit 16. Four developing units 21, 23, 25 and 27 are disposed so as to contact the photosensitive drums 20, 22, 24 and 26, respectively. The four developing units 21, 23, 25 and 27 correspond to magenta (M), yellow (Y), black (B) and cyan (C) toner, respectively. Static electricity latent images formed on outer peripheral surfaces (image-bearing surfaces) of the photosensitive drums 20, 22, 24 and 26 are developed to form toner images with the M toner, Y toner, K toner and C toner, respectively.

The toner images formed at the four photosensitive drums 20, 22, 24 and 26 are transferred to an intermediate transfer belt disposed at the process unit 16 side, and superposed to form a full-color toner image. This full-color toner image is transferred from the intermediate transfer belt to a recording material such as recording paper or the like. Then, the recording material is heated and fixed for recording. It is also possible for the laser printer 10 to record a monochrome toner image, formed only of K toner, on the recording material. The recording material on which the toner image has been recorded is ejected to an ejection tray portion 28 at an upper surface portion of the housing 12, or to (one of) ejection trays 30 and 32, which are attached so as to extend sideward at a side surface portion of the housing 12.

Figure 2:
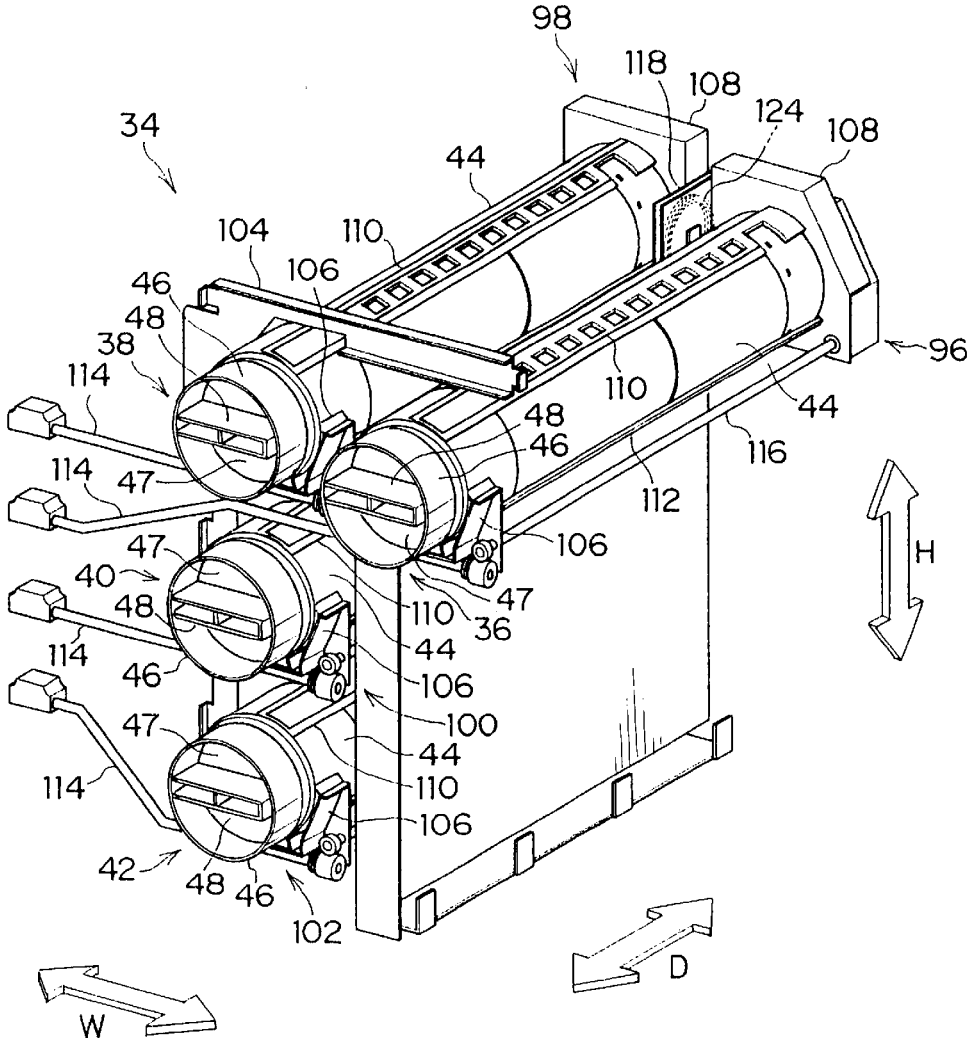
FIG. 2 is a perspective view showing structure of a cartridge holder, at which toner cartridges are detachably mounted, in the laser printer shown in FIG. 1.

A cartridge holder 34 is provided at the laser printer 10, so as to be adjacent to the main frame 14 along the transverse direction. As shown in FIG. 2, four toner cartridges 36, 38, 40 and 42, which are respectively formed into substantially cylindrical shapes, are detachably mounted at the cartridge holder 34. The toner cartridges 36, 38, 40 and 42 are filled with respectively different colors of toner at internal portions thereof (magenta (M) toner, yellow (Y) toner, black (B) toner and cyan (C) toner).

As shown in FIG. 1, an opening/closing door 13 for maintenance is openably/closeably provided at the housing 12. The door 13 is provided at a one-side side surface portion (at the front side of the paper on which FIG. 1 is drawn), facing the process unit 16 and the cartridge holder 34. Consequently, a user or the like can open the opening/closing door 13, expose the process unit 16 and the cartridge holder 34 to the exterior, pull out the process unit 16 from the main frame 14, and attach/detach the toner cartridges 36, 38, 40 and 42 to and from the cartridge holder 34.

The toner cartridges 36, 38, 40 and 42 mounted at the cartridge holder 34 are structured as containers for temporarily accommodating toner. That is, in the laser printer 10, when the developing units 21, 23, 25 and 27 operate, toner is discharged from inside the toner cartridges 36, 38, 40 and 42, and supplied to the developing units 21, 23, 25 and 27. When all of the toner in one of the toner cartridges 36, 38, 40 and 42 has been discharged, that toner cartridge 36, 38, 40 or 42 is replaced with a new toner cartridge. At this time, toner inside the toner cartridge 36, 38, 40 or 42 is sealed therein. Therefore, resupply of toner to the laser printer 10 can be performed by a simple operation, and scattering of toner and soiling of the interior and exterior of the device at the time of toner resupply can be effectively prevented.

As shown in FIG. 2, the toner cartridges 36, 38, 40 and 42 are provided with cylindrical bodies 44, which are formed from resin material in thin-walled cylindrical shapes. A closeable opening (not shown) is formed in each of the cylindrical bodies 44, communicating to the interior from one end surface along the axial direction of the cylindrical body 44 (a trailing end surface). A cylindrical closing cylinder 46 is pressed in at a trailing end portion of the cylindrical body 44, and attached by adhesion or the like. The closing cylinder 46 closes the closeable opening. The closing cylinder 46 is formed with a thin-walled cylindrical shape having substantially the same diameter as the cylindrical body 44. An inner peripheral side of the closing cylinder 46 is closed by a circular plate-like baseplate portion 47. A handling portion 48 is also integrally formed in the closing cylinder 46, at an outer side of the baseplate portion 47.

Figure 3:
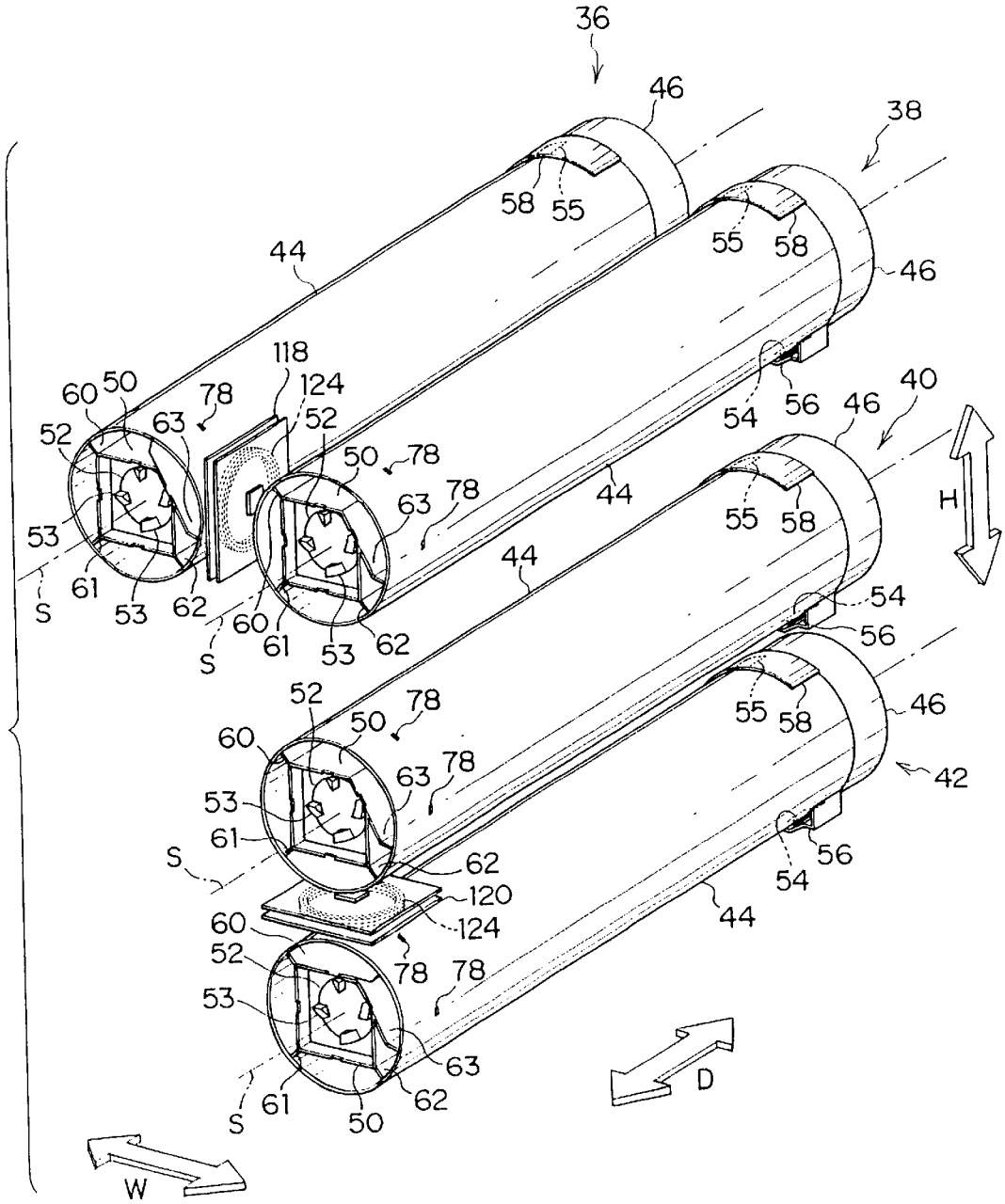
FIG. 3 is a perspective view showing structure of the toner cartridges and antenna units of a wireless communication device in the laser printer shown in FIG. 1.

As shown in FIG. 3, an inner periphery barrel portion 50 is integrally provided at an inner peripheral side of a peripheral wall portion at a leading end portion of the cylindrical body 44. The inner periphery barrel portion 50 has a substantially rectangular cross section. At a baseplate portion of the inner periphery barrel portion 50, a circular plate-like driven coupling plate 52 is disposed so as to be rotatable around an axial center S of the cylindrical body 44. A plurality of gear teeth 53 is integrally formed along a peripheral direction at a leading surface side of the driven coupling plate 52. A screw feeder for delivering toner (not shown), which is formed in a screw shaft shape, is disposed coaxially inside the cylindrical body 44. The screw feeder couples with the driven coupling plate 52 and rotates integrally with the driven coupling plate 52.

A toner supply aperture 54 and a toner filling aperture 55 are respectively provided at a leading end side of the peripheral wall portion of the cylindrical body 44. A shutter member 56 (see FIG. 4) is disposed at an outer peripheral side of the toner supply aperture 54, and is slideable along the peripheral direction. The shutter member 56 is slideable between an opened position and a closed position. When the shutter member 56 is at the opened position, the toner supply aperture 54 is open. When the shutter member 56 is at the closed position, the toner supply aperture 54 is closed. The shutter member 56 is constantly urged toward the closed position by an unillustrated urging member such as a coil spring or the like. Therefore, the shutter member 56 is maintained at the closed position when the toner cartridge 36, 38, 40 or 42 is not mounted at the cartridge holder 34. A cap member 58 is fixed at an outer peripheral side of the toner filling aperture 55 at the peripheral wall portion of the cylindrical body 44. The cap member closes the toner filling aperture 55.

Figure 4:
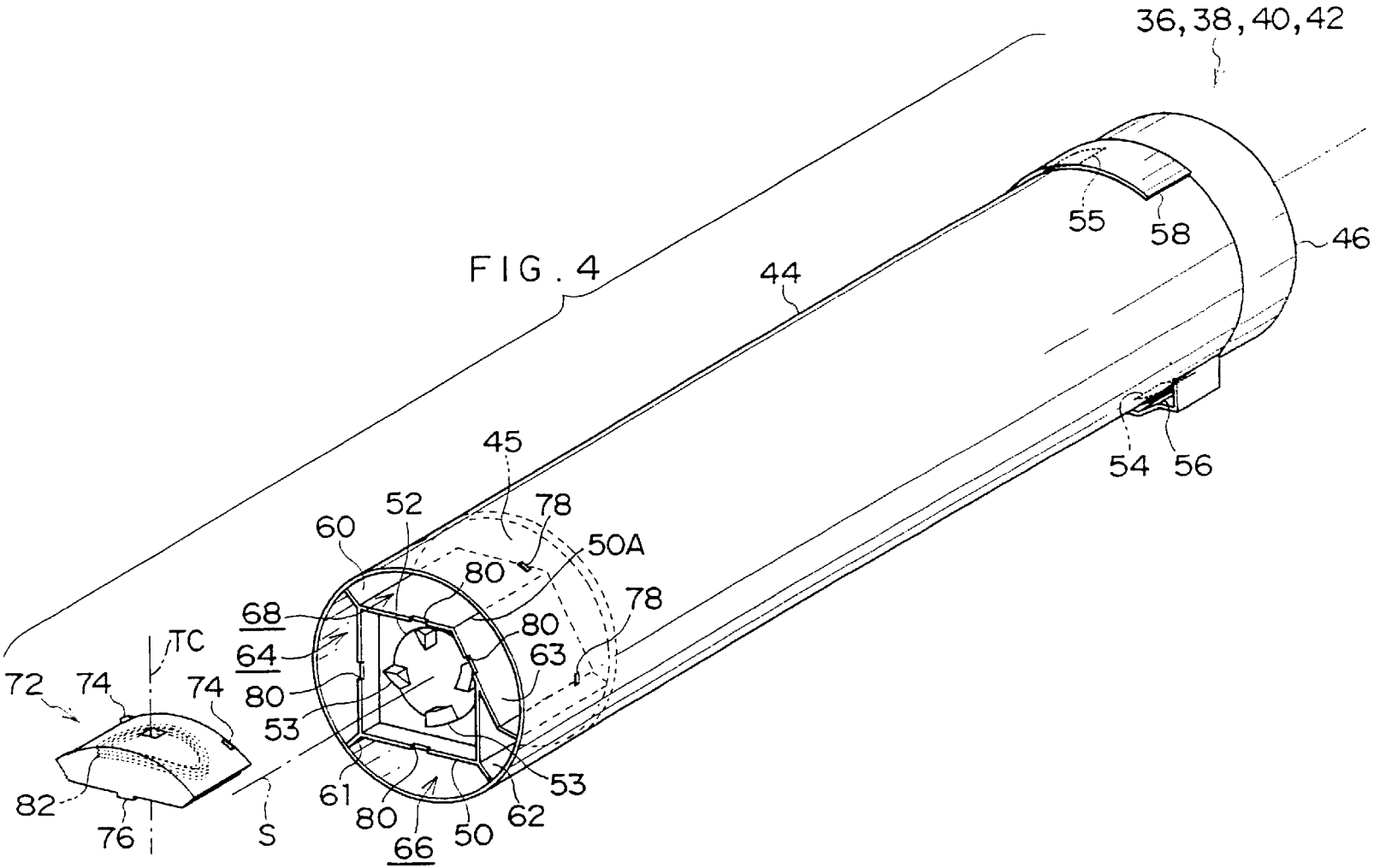
FIG. 4 is an exploded perspective view showing structure of a toner cartridge in the laser printer shown in FIG. 1 and a wireless communication tag attached to the toner cartridge.
Figure 6:
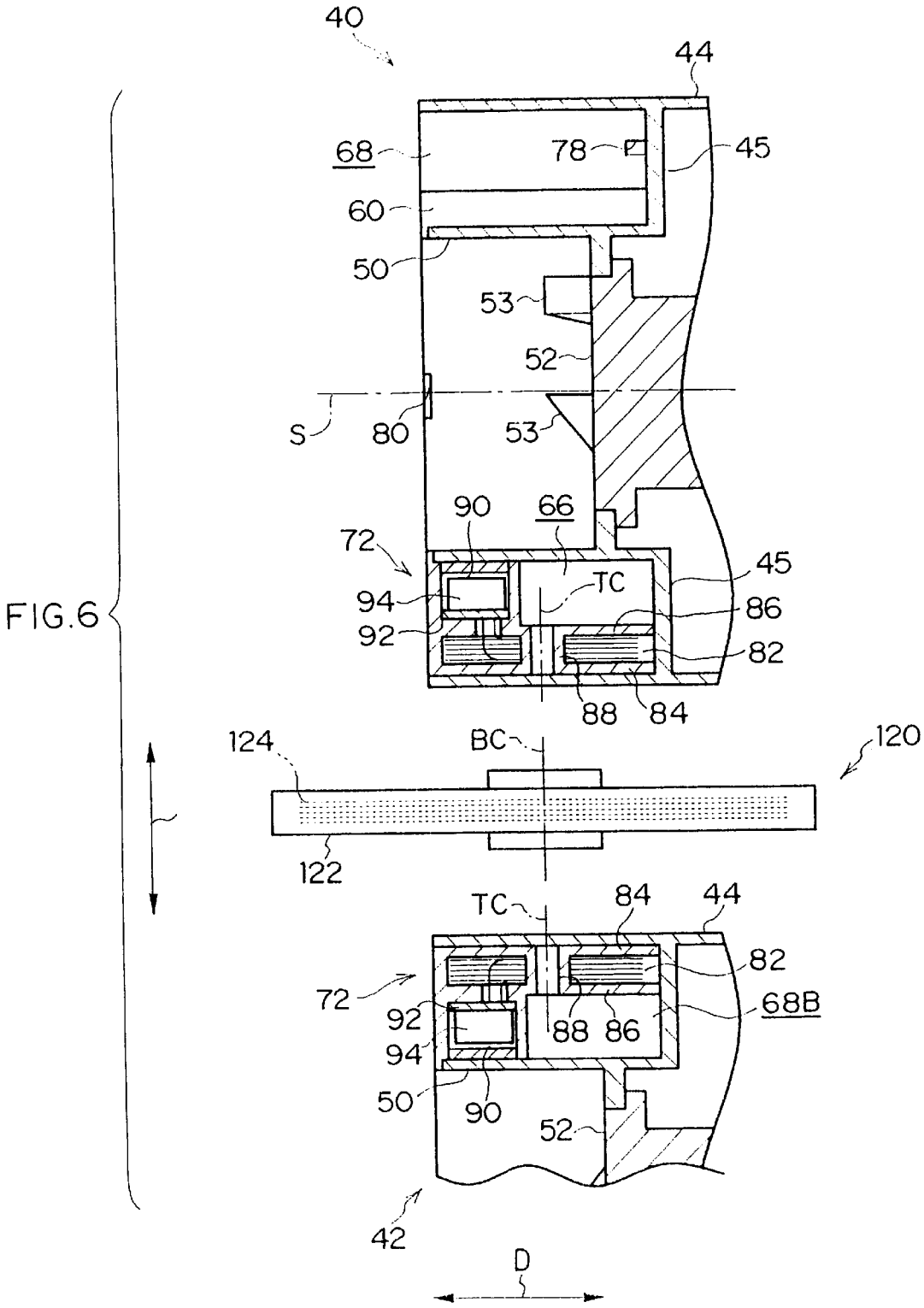
FIG. 6 is a side sectional view showing structure of the wireless communication tags attached to the toner cartridges and the antenna unit of the wireless communication device in the laser printer shown in FIG. 1.

As shown in FIG. 4, at the leading end portion of the cylindrical body 44, four partition plates 60, 61, 62 and 63 are formed in rib shapes in a space formed between the inner peripheral surface of the peripheral wall portion and an outer peripheral surface of the inner periphery barrel portion 50, so as to connect the peripheral wall portion and the inner periphery barrel portion 50. These partition plates 60, 61, 62 and 63 divide the ring-like space formed in the cylindrical body 44 between the peripheral wall portion and the inner periphery barrel portion 50 into smaller spaces along the peripheral direction. These smaller spaces open out at a leading end face of the cylindrical body 44 and, as shown in FIG. 6, are closed by the base plate portion 45 of the cylindrical body 44 at a trailing end side of the cylindrical body 44.

Figure 5:
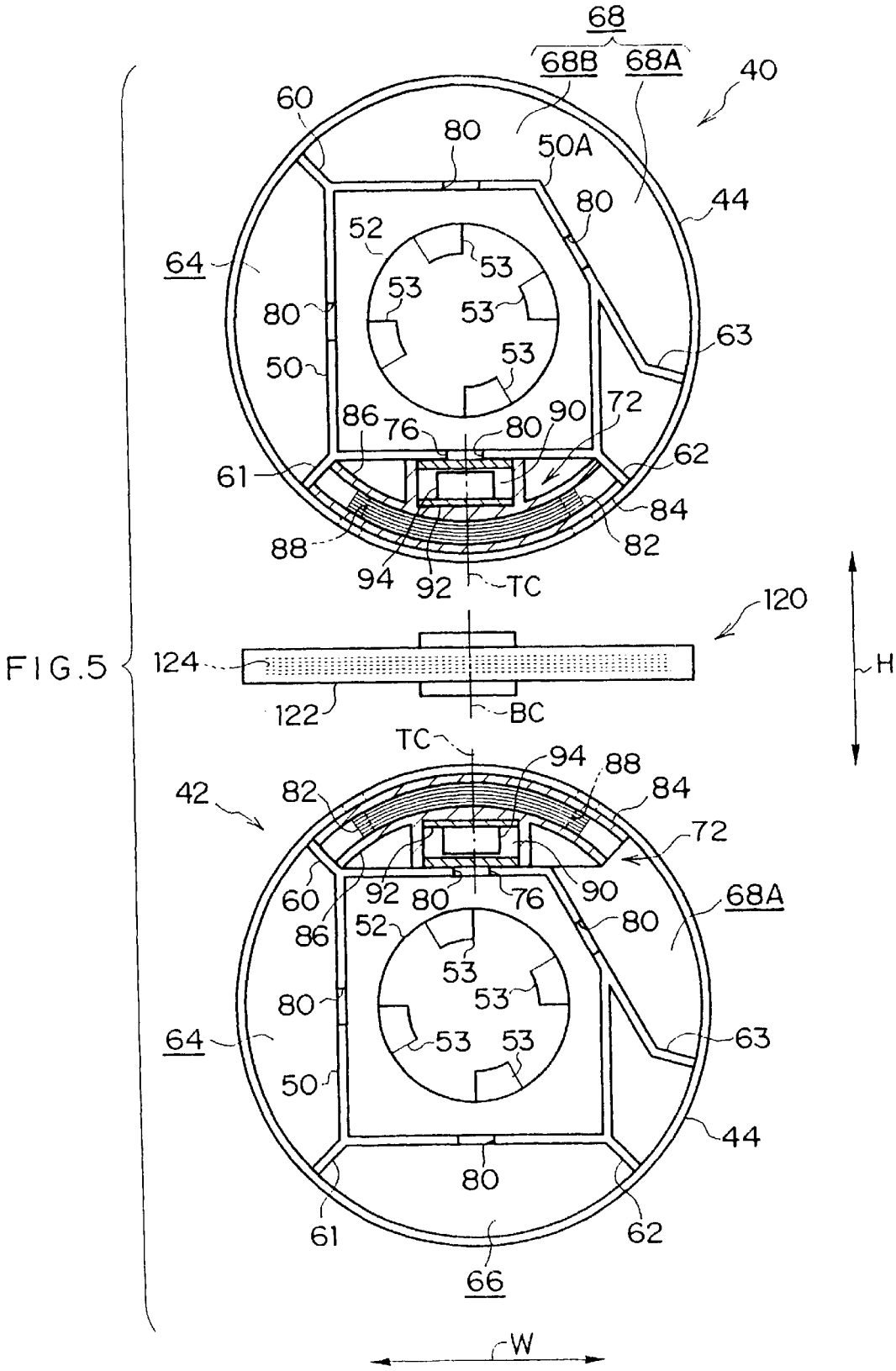
FIG. 5 is an elevational view, as seen from an axial direction outer side, of wireless communication tags attached to toner cartridges and an antenna unit of a wireless communication device in the laser printer shown in FIG. 1.

Here, the smaller space between the partition plate 60 and the partition plate 61 in the cylindrical body and the smaller space between the partition plate 61 and the partition plate 62 are structured as accommodation chambers 64 and 66, respectively, for accommodating a single wireless communication tag 72, which is described later. The smaller space between the partition plates 60 and 63 is also structured as an accommodation chamber 68 for accommodating the single wireless communication tag 72 (see FIG. 4). However, as shown in FIG. 5, the accommodation chamber 68 is functionally divided into an accommodation portion 68A and an accommodation portion 68B, with a boundary therebetween being at the vicinity of an edge portion 58A of the inner periphery barrel portion 50. The wireless communication tag 72 can be selectively accommodated in either of the two accommodation portions 68A and 68B at the accommodation chamber 68. Therefore, the single wireless communication tag 72 can be selectively accommodated at any of the accommodation chamber 64, the accommodation chamber 66, and the two accommodation portions 68A and 68B of the accommodation chamber 68. An attachment position of the wireless communication tag 72 varies along the peripheral direction in accordance with the selected accommodation chamber 64 or 66 or accommodation portion 68A or 68B.

As shown in FIG. 4, a projected shape of the wireless communication tag 72, as viewed from the axial direction, is substantially a hand-fan shape corresponding to either of the accommodation chambers 64, 66A and 68B. The wireless communication tag 72 fits into any of the accommodation chamber 64, the accommodation chamber 66, and the accommodation portions 68A and 68B of the accommodation chamber 68. Thus, the wireless communication tag 72 is accommodated and held in any of the accommodation chambers 64 and 66 and the accommodation portions 68A and 68B. A pair of anchoring pawls 74 are formed on the wireless communication tag 72 at an insertion side end portion of an outer peripheral surface thereof, protruding to an outer peripheral side. Also, an engaging protrusion 76 is formed at an insertion aperture side end surface portion, protruding to an axial center S side. Anchoring holes 78 are formed in the peripheral wall portion of the cylindrical body 44, corresponding to the anchoring pawls 74, in each of the accommodation chambers 64 and 66 and the accommodation portions 68A and 68B. At a trailing end surface of the inner periphery barrel portion 50, an engaging depression 80, corresponding to the engaging protrusion 76 on the wireless communication tag 72, is formed in each of the accommodation chambers 64 and 66 and the accommodation portions 68A and 68B.

Accordingly, when the wireless communication tag 72 is fitted into the one of the accommodation chambers 64 and 66 and the accommodation portions 68A and 68B, the outer peripheral surface of the wireless communication tag 72 is in a state of close contact with the inner peripheral surface of the cylindrical body 44. The pair of anchoring pawls 74 is fitted into the pair of anchoring holes 78, and the engaging protrusion 76 engages with the engaging depression (concave portoin) 80. Hence, movement along the axial direction is reliably constrained. Moreover, because the engaging protrusion 76 engages with the engaging depression 80, the occurrence of looseness along the peripheral direction is reliably prevented. Here, as long as the wireless communication tag 72 itself is not resiliently deformed at an inner peripheral side, the anchoring pawls 74 inserted in the anchoring holes 78 will not come out. Therefore, the wireless communication tag 72 inserted in the one of the accommodation chambers 64 and 66 and the accommodation portions 68A and 68B cannot be easily removed without using a specialized jig or the like.

As is also shown in FIG. 4, a tag side antenna 82 is provided at the wireless communication tag 72. The tag side antenna 82 is structured by a conductive wiring material, such as copper or the like, wound into a coil shape. The tag side antenna 82 is provided such that a coil axis TC at a winding center of the conductive wiring is substantially parallel with a thickness direction of the wireless communication tag 72. The shape of a coil surface along a direction intersecting this axis curves along with the outer peripheral surface of the wireless communication tag 72. Specifically, an outer wall portion 84 and an inner wall portion 86 are provided at the wireless communication tag 72, as shown in FIG. 5 and FIG. 6. The outer wall portion 84 and the inner wall portion 86 curve substantially parallel to one another. A winding core 88 is connected between the outer wall portion 84 and the inner wall portion 86. The conductive wiring is wound around at an outer peripheral side of this winding core 88. Thus, the tag side antenna 82, which is flat along the axial direction, is structured so as to curve along the outer peripheral surface of the wireless communication tag 72.

A separation chamber portion 90 is also provided at the wireless communication tag 72. The separation chamber portion 90 is provided at the inner peripheral side of the tag side antenna 82 and is closed off from the outside. A circuit board 92 is accommodated at the separation chamber portion 90. An IC chip 94 is mounted on the circuit board 92. Control circuitry of the wireless communication tag 72 is integrated into the single IC chip 94. The IC chip 94 is electrically connected to the tag side antenna 82 through the circuit board 92 or the like.

As shown in FIG. 2, attachment/detachment portions 96, 98, 100 and 102 are provided at the cartridge holder 34 which is provided at the device main body side. The two attachment/detachment portions 96 and 98 are provided at an upper level portion along the height direction of the device (the direction of arrow H). The attachment/detachment portions 100 and 102 are provided one at each of a middle level portion and a low level portion in the height direction. One each of the toner cartridges 36, 38, 40 and 42 is detachably mounted at each of the attachment/detachment portions 96, 98, 100 and 102. Thus, the four toner cartridges 36, 38, 40 and 42 mounted at the cartridge holder 34 substantially form an inverted L-shaped arrangement when viewed from an axial direction outer side thereof. Therefore, an increase in overall dimension of the four toner cartridges 36, 38, 40 and 42 in the height direction of the device is restrained compared to a case of arrangement in a straight line along the height direction.

As shown in FIG. 2, four driving plates 108 are provided in correspondence with mounting positions of the four toner cartridges 36, 38, 40 and 42 at a device deeper side end portion of the cartridge holder 34 (in FIG. 2, only the two driving plates 108 at the upper level portion are shown). The exterior form of each of the driving plates 108 is a thin plate shape. The driving plates 108 are supported such that thickness directions thereof are aligned with the depth direction of the device. Driving coupling plates (not shown) are rotatably disposed at the driving plates 108. Face portions of the driving coupling plates, which oppose leading end surfaces of the toner cartridges 36, 38, 40 and 42, oppose the driven coupling plates 52 of the toner cartridges 36, 38, 40 and 42 (see FIG. 4). The driving coupling plates basically have forms that reflect (correspond to) the forms of the driven coupling plates 52, and the driving coupling plates can mesh with the driven coupling plates 52. Drive motors (not shown) are incorporated in the respective driving plates 108. These drive motors rotate and turn the driving coupling plates during operation of the developing units 21, 23, 25 and 27.

As shown in FIG. 2, a support plate 104 is provided at the cartridge holder 34, at a device forward side end portion thereof. The support plate 104 extends in an inverted L shape to surround the four toner cartridges 36, 38, 40 and 42. Four support brackets 106 are connectedly fixed to the support plate 104 at mounting positions in correspondence with mounting positions of the four toner cartridges 36, 38, 40 and 42. When the four toner cartridges 36, 38, 40 and 42 are mounted at the cartridge holder 34, the four toner cartridges 36, 38, 40 and 42 bridge between the support brackets 106 and the driving plates 108. Moreover, when the four toner cartridges 36, 38, 40 and 42 are mounted at the cartridge holder 34, the four toner cartridges 36, 38, 40 and 42 are supported at leading end portions and trailing end portions by the driving plates 108 and the support brackets 106. Further, shutter-engaging portions (not shown), which are engageable with the shutter members 56 of the toner cartridges 36, 38, 40 and 42, are provided at the support brackets 106.

As is further shown in FIG. 2, two guide members 110 and 112 are provided at each of the attachment/detachment portions 96, 98, 100 and 102 of the cartridge holder 34, between the drive plates 108 and the support plates 106. The guide members 110 and 112 are provided extending in a depth direction. When the toner cartridges 36, 38, 40 and 42 are inserted into or removed from the cartridge holder 34, the toner cartridges are guided by the guide members 110 and 112 so as to move in a straight line in the depth direction.

In the laser printer 10, when the toner cartridges 36, 38, 40 and 42 are to be mounted at the corresponding attachment/detachment portions 96, 98, 100 and 102 at the cartridge holder 34, first, the toner cartridges 36, 38, 40 and 42 are inserted towards the device deeper side along the depth direction until the leading end portions of the toner cartridges 36, 38, 40 and 42 abut against the driving plates 108. Thus, the leading end portions of the toner cartridges 36, 38, 40 and 42 are connected with the driving plates 108 and supported. Also, the shutter-engaging portions of the support brackets 106 engage with the shutter members 56 of the toner cartridges 36, 38, 40 and 42.

Next, using the handling portions 48, the toner cartridges 36, 38, 40 and 42 are rotated by just a predetermined angle in a clockwise direction. Thus, mounting of the toner cartridges 36, 38, 40 and 42 in the attachment/detachment portions 96, 98, 100 and 102 is completed. Now, the driving coupling plates disposed at the driving plates 108 mesh with the driven coupling plates 52 of the toner cartridges 36, 38, 40 and 42. Thus, the drive motors incorporated in the driving plates 108 are linked so as to be able to transmit torque to the screw feeders in the toner cartridges 36, 38, 40 and 42, through the driving coupling plates and the driven coupling plates 52. Also, interlockingly with the rotation of the toner cartridges 36, 38, 40 and 42 at the attachment/detachment portions 96, 98, 100 and 102, the shutter members 56 of the toner cartridges 36, 38, 40 and 42 are slid from the closed position to the opened position by the shutter-engaging portions of the support brackets 106. Thus, the toner supply apertures 54 are opened.

As shown in FIG. 2, in the laser printer 10, toner supply pipes 114 are provided between the respective attachment/detachment portions 96, 98, 100 and 102 at the cartridge holder 34 and the developing units 21, 23, 25 and 27. One end portions of these toner supply pipes 114 are connected at the support brackets 106. When the toner cartridges 36, 38, 40 and 42 are mounted at the attachment/detachment portions 96, 98, 100 and 102, the toner supply pipes 114 are connected to the toner supply apertures 54 of the toner cartridges 36, 38, 40 and 42 via the toner support brackets 106. Unillustrated screw feeders for transporting the toner are disposed at the toner supply pipes 114. Torque is transmitted to these screw feeders from the drive motors in the driving plates 108 via torque transmission shafts 116 or the like.

In the laser printer 10, during operation of the developing units 21, 23, 25 and 27, the drive motors built into the driving plates 108 rotate in correspondence with the operating developing units 21, 23, 25 and 27. Consequently, toner is discharged from the toner supply apertures 54 of the toner cartridges 36, 38, 40 and 42 at a predetermined speed due to the action of the screw feeders. This toner passes through the toner supply pipes 114 and is supplied to the operating developing units 21, 23, 25 and 27. At this time, the amounts of toner supplied to the developing units 21, 23, 25 and 27 are set to be substantially the same as amounts of toner consumed for development.

As shown in FIG. 3, plate-like antenna units 118 and 120 are disposed at the cartridge holder 34, at a device deeper side between the attachment/detachment portions 96 and 98 and at a device deeper side between the attachment/detachment portions 100 and 102, respectively. Casing portions 122 are provided at the two antenna units 118 and 120. The casing portions 122 are formed of resin in thin-walled plate shapes. Main body side antennas 124 are disposed in the casing portions 122. The main body side antennas 124 are formed of conductive wiring, such as copper wire or the like, wound into coil shapes. A coil axis BC of the antenna units 118 and 120 is set to be parallel to a thickness direction of the corresponding casing portion 122. Front and back surfaces along directions intersecting this axis (coil surfaces) are set to be parallel to surface directions of the casing portion 122. The antenna unit 118 is disposed at the upper level portion of the cartridge holder 34. The antenna unit 118 is supported such that surface directions thereof intersect the transverse direction of the device (the direction of the arrow W). The antenna unit 120 is disposed between the middle level portion and the lower level portion of the cartridge holder 34. The antenna unit 120 is supported such that surface directions thereof intersect the height direction of the device (the direction of the arrow H).

As is also shown in FIG. 3, when the toner cartridges 36, 38, 40 and 42 are mounted at the cartridge holder 34, the upper antenna unit 118 is supported so as to be interposed in the transverse direction of the device in a gap formed between the toner cartridges 36 and 38. The lower antenna unit 120 is supported so as to be interposed in the height direction of the device in a gap formed between the toner cartridges 40 and 42.

In the toner cartridge 36 mounted at the attachment portion 96 in the cartridge holder 34, one of the wireless communication tags 72 is fitted in the accommodation portion 68A at the accommodation chamber 68. In the toner cartridge 38 mounted at the attachment portion 98, one of the wireless communication tags 72 is fitted in the accommodation chamber 64. Thus, a coil surface of the tag side antenna 82 in the toner cartridge 36 is sufficiently close to and directly faces (correspondingly faces) one coil surface in the thickness direction of the main body side antenna 124 of the antenna unit 118. Also, a coil surface of the tag side antenna 82 in the toner cartridge 38 is sufficiently close to and faces the other coil surface in the thickness direction of the main body side antenna 124.

In the toner cartridge 40 mounted at the attachment portion 100 in the cartridge holder 34, one of the wireless communication tags 72 is fitted into the accommodation chamber 66. In the toner cartridge 42 mounted at the attachment portion 102, one of the wireless communication tags 72 is fitted into the accommodation portion 68B at the accommodation chamber 68. Thus, a coil surface of the tag side antenna 82 in the toner cartridge 40 is sufficiently close to and directly faces one coil surface in the thickness direction of the main body side antenna 124 of the antenna unit 120. Also, a coil surface of the tag side antenna 82 in the toner cartridge 42 is sufficiently close to and directly faces the other coil surface in the thickness direction of the main body side antenna 124.

Here, the smaller the separation between the tag side antennas 82 and the main body side antennas 124, the more improved the efficiency of electromagnetic transmission and reception between the antennas. Also, the closer the tag side antennas 82 and the main body side antennas 124 are to coaxial positional relationships, the more improved the efficiency is. In the laser printer 10, the tag antennas 82 attached to the toner cartridges 38, 40 and 42 are supported substantially coaxially with the main body side antennas 124, and the separations between the antennas meet predetermined conditions. Thus, it is possible to obtain substantially optimal efficiency of electromagnetic transmission to and reception from the main body side antennas 124. The tag side antenna 82 attached at the toner cartridge 36 is supported to be inclined at a certain angle (about 20°) relative to the main body side antenna 124. However, the separation from the main body side antenna 124 is sufficiently small. Therefore, electromagnetic transmission and reception can attain a very high efficiency. In other words, provided electromagnetic output used between the wireless communication tags 72 and a main body side wireless communication device 130 (see FIG. 7) is sufficiently small, a preferable wireless communication state will be maintained, and miscommunication between the main body side antenna 124 and the wireless communication tag 72 between which a communicative relationship is not specified can be reliably prevented, namely, interference of communication can be prevented.

Structure and Operation of Wireless Communication System

Now, structure and operation of a wireless communication system in a laser printer relating to the embodiment constituted as described above will be described.

Figure 7:
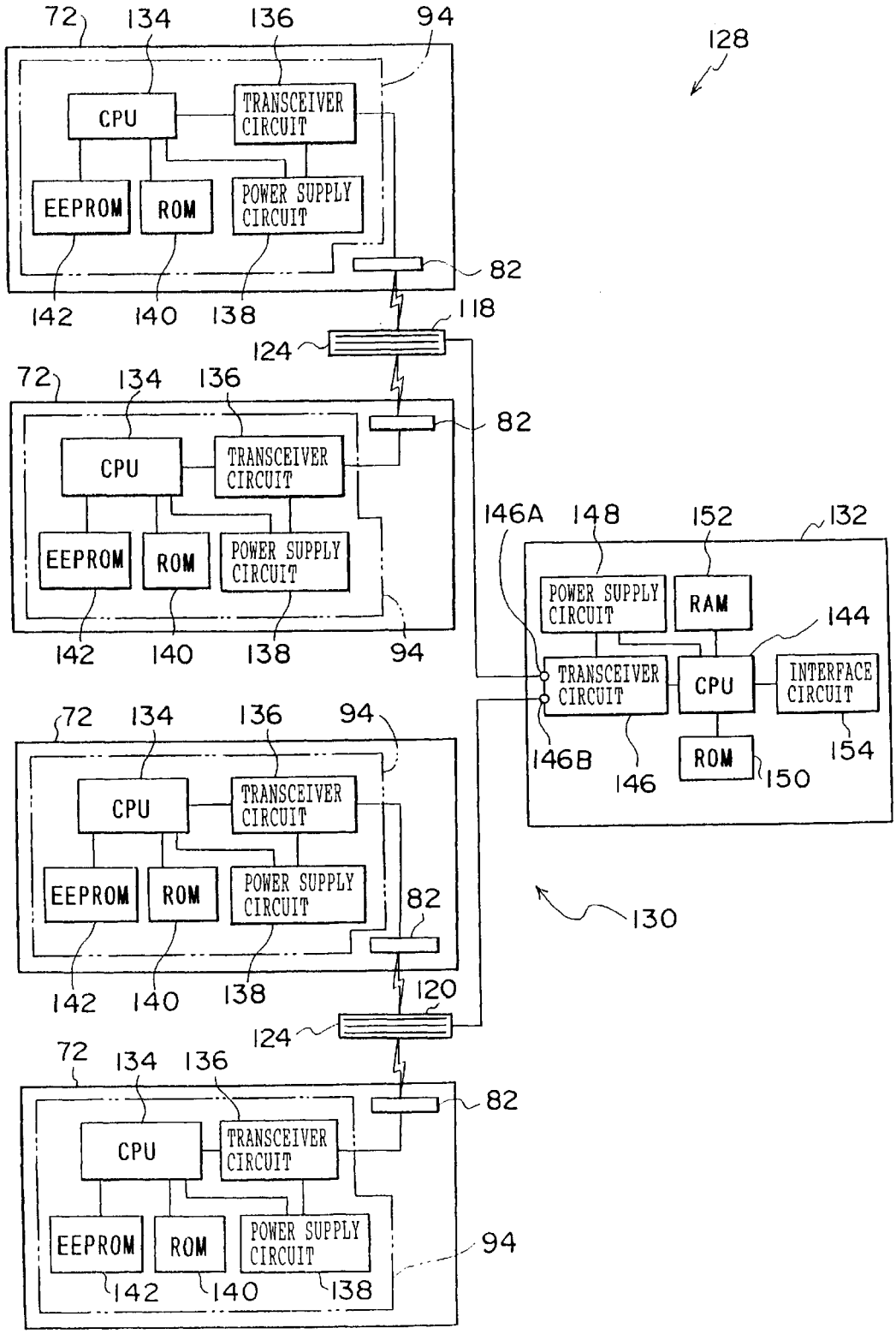
FIG. 7 is a block diagram showing structure of a wireless communication system in a laser printer relating to an embodiment of the present invention.

FIG. 7 shows the constitution of the wireless communication system relating to the embodiment of the present invention as a block diagram. This wireless communication system 128 is structured by the wireless communication tags 72, which are attached at the four toner cartridges 36, 38, 40 and 42, and the wireless communication device 130, which is disposed at the device main body side. The wireless communication device 130 is provided with the antenna units 118 and 120, which are disposed at the cartridge holder 34, and a main body section 132, which is connected to the main body side antennas 124 incorporated in the antenna units 118 and 120.

As described above, each of the wireless communication tags 72 attached to the toner cartridges 36, 38, 40 and 42 is provided with the IC chip 94 mounted on the circuit board 92 and the coil-shaped tag side antenna 82. As shown in FIG. 7, the IC chip 94 is structured by a single component in which a CPU 134, a transceiver circuit 136, a power supply circuit 138, a ROM 140 and an EEPROM 142 are integrated. The CPU 134 controls the overall wireless communication tag 72 in accordance with a control program stored at the ROM 140. In addition to the control program, characteristic information corresponding to the type of the toner cartridge 36, 38, 40 or 42 is stored in the ROM 140. The characteristic information includes a multi ID, a password and a system ID. The multi ID essentially includes predetermined data corresponding to the type of the toner cartridge 36, 38, 40 or 42. The password and system ID include data for verifying that the wireless communication tag 72 is permitted to exchange information with the wireless communication device 130.

The EEPROM 142 is a non-volatile information storage component, which does not require electricity to maintain stored information. The EEPROM 142 can have arbitrary information written thereto by the CPU 134, and the written information can be arbitrarily read out. Specifically, the CPU 134 may write, for example, the following information to the EEPROM 142, and the contents of the written information may be changed as necessary.

1) Process information for the photosensitive drums 20, 22, 24 and 26, such as exposure amounts, charging amounts, developing bias and the like.
2) For the toner cartridges 36, 38, 40 and 42, lot numbers, manufacturing dates, types, storage durations, identification numbers, numbers of times recycled, upper limit on number of times for recycling, and replacement dates for structural components of the cartridges.
3) For the toners, lot numbers, production dates, filling amounts, types, storage durations, numbers of times recycled, and upper limit on number of times for recycling.

At a time of information transmission, the transceiver circuit 136 at the wireless communication tag 72 converts a parallel information signal sent from the CPU 134 to a serial information signal. An electrical signal is modulated in accordance with this information signal and outputted to the tag side antenna 82. Accordingly, the tag side antenna 82 outputs (radiates) an electromagnetic signal corresponding to the information signal from the CPU 134. At a time of information reception, the transceiver circuit 136 demodulates an electrical signal, which is obtained from an electromagnetic signal received by the tag side antenna 82, to a serial signal. The transceiver circuit 136 converts this serial signal to a parallel information signal and outputs the parallel information signal to the CPU 134.

During transmission/reception to/from the wireless communication device 130, the power supply circuit 138 at the wireless communication tag 72 separates the information signals from an alternating current having a predetermined frequency, which is generated at the tag side antenna 82 by electromagnetic induction. The power supply circuit 138 converts this alternating current to a direct current. Then, the power supply circuit 138 supplies direct current to the CPU 134 and the transceiver circuit 136. Thus, power required during transmission/reception to/from the wireless communication device 130 is supplied to the CPU 134 and the transceiver circuit 136. Consequently, there is no need for a power supply such as a cell, a battery or the like at the wireless communication tag 72.

As shown in FIG. 7, a main body portion of the wireless communication device 130 is provided with a CPU 144, a transceiver circuit 146, a power supply circuit 148, a ROM 150, a RAM 152 and an interface circuit 154. Two input/output terminals 146A and 146B are provided at the transceiver circuit 146 in correspondence to the antennas. One of these input/output terminals 146A is connected to the main body side antenna 124 of the antenna unit 118. The other of the input/output terminals 146B is connected to the main body side antenna 124 of the antenna unit 120. During information transmission/reception to/from the wireless communication tags, the transceiver circuit 146 puts one of the input/output terminals 146A and 146B into an 'on' state in accordance with the target of input/output, and puts the other of the input/output terminals 146A and 146B into an 'off' state.

The CPU 144 controls the wireless communication device 130 in accordance with a control program stored at the ROM 150. In addition to the control program, multi IDs, passwords and system IDs for all of the toner cartridges 36, 38, 40 and 42 are stored at the ROM 150. The CPU 144 compares multi IDs and passwords inputted from the wireless communication tags 72 with the multi IDs and passwords stored at the ROM 150. Hence, during electromagnetic communication, the CPU 144 identifies the types of the toner cartridges 36, 38, 40 and 42 at which the wireless communication tags 72 are attached, and confirms whether or not the wireless communication tags 72 are entitled to exchange information with the wireless communication device 130.

Process information for each of the photosensitive body drums 20, 22, 24 and 26 of the toner cartridges 36, 38, 40 and 42, such as exposure amounts, static charging amounts, development bias and the like, is sent to the CPU 144 via the interface circuit 154 from a central control portion of the laser printer 10 (not shown). The CPU 144 calculates toner consumption amounts on the basis of this process information, and writes information to be temporarily stored at the RAM 152. Subsequently, information to be transmitted is read out from the RAM 152 with a predetermined timing, and transmitted to the wireless communication tags 72. Consequently, the CPU 134 of each wireless communication tag 72 writes information received from the wireless communication device 130 to the EEPROM 142. The CPU 134 subtracts a consumption amount from a filled amount of the toner and records a remaining toner amount at the EEPROM 142.

At the time of information transmission from the wireless communication device 130, the transceiver circuit 146 at the main body portion receives a parallel information signal from the CPU 144. The transceiver circuit 146 converts the parallel information signal to a serial information signal. Then, an electrical signal is modulated in accordance with this information signal and outputted to either of the two main body side antennas 124. Accordingly, the main body side antenna 124 outputs (radiates) electromagnetic signals corresponding to the information signals from the CPU 144. When the transceiver circuit 146 is receiving information, an electrical signal obtained from electromagnetic waves received by the main body side antennas 124 is demodulated to a serial information signal. This information signal is converted to a parallel information signal and outputted to the CPU 144.

When the main body portion is in communication with any of the wireless communication tags 72, the power supply circuit 148 at the main body portion supplies alternating current of the predetermined frequency to the main body side antenna 124. Consequently, electromagnetic induction is caused at the tag side antenna 82 facing the main body side antenna 124 and, as described above, electric power is supplied to the wireless communication tag 72. The frequency of the alternating current supplied to the main body side antenna 124 by the power supply circuit 148 is selected to be in the same range as the frequency of the electrical signals used for information transmission by the transceiver circuits 136 and 146 when transmitting. When receiving, a different range is selected (for example, a high frequency range).

When the main body portion CPU 144 judges that all the toner in one of the toner cartridges 36, 38, 40 and 42 has been discharged, an increment signal is transmitted to the wireless communication tag 72 which is attached at that toner cartridge 36, 38, 40 or 42. The CPU 134 of the wireless communication tag 72 which receives this increment signal writes to the EEPROM 142, and increases by 1 a number of times recycled and a number of times of recycling of the toner for that toner cartridge 36, 38, 40 or 42.

Figure 8:
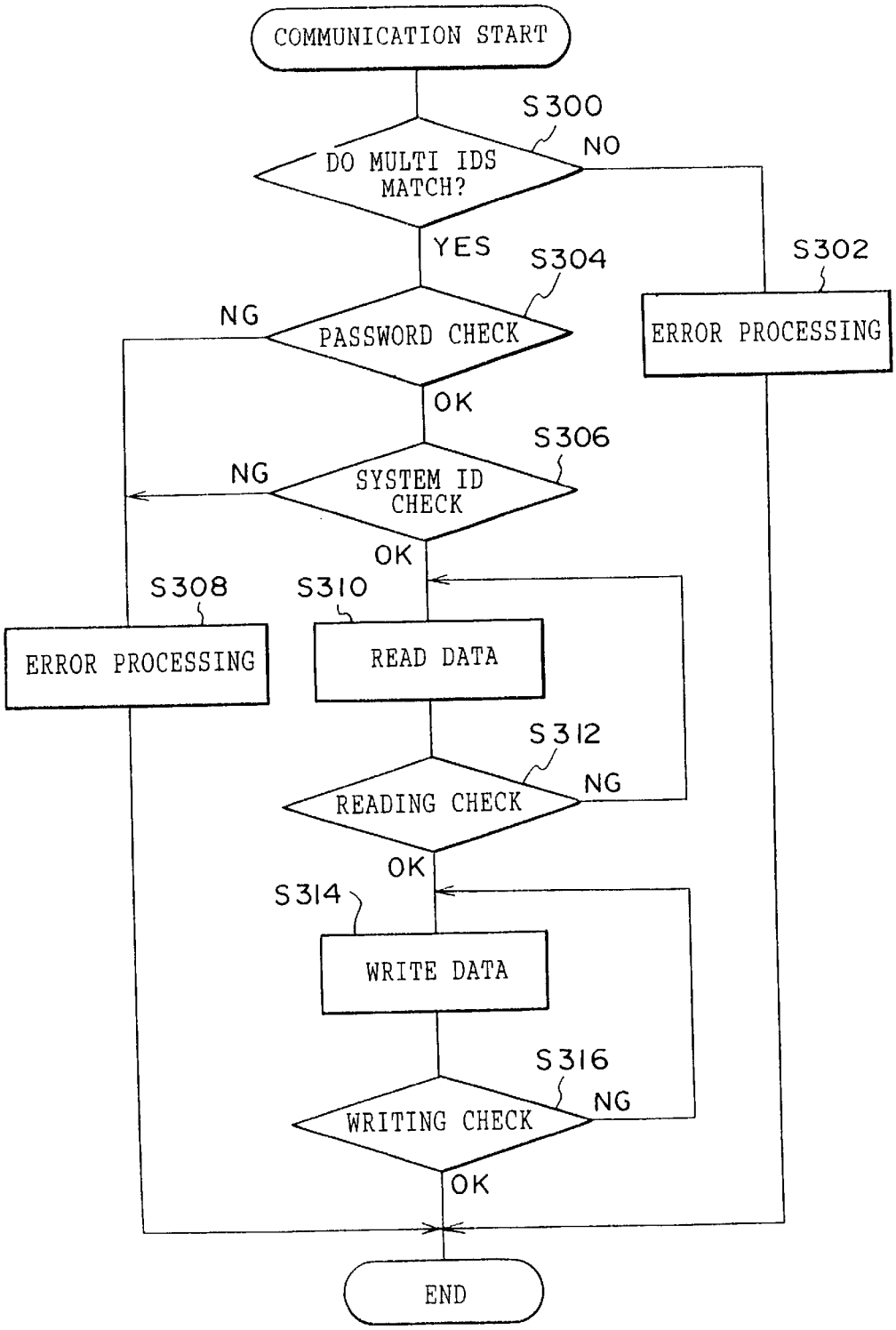
FIG. 8 is a flowchart showing operation during communication commencement processing by the wireless communication system relating to the embodiment of the present invention.

FIG. 8 shows a sequence of operations for communication commencement processing in the wireless communication system 128 relating to the present embodiment. At a time when the laser printer 10 has been connected to a power supply, the toner cartridges 36, 38, 40 and 42 have been exchanged, reset processing has been performed after the occurrence of a fault such as a jam or the like, or the like, the communication commencement processing of the wireless communication system 128, as shown in FIG. 8, is carried out by the CPU 144 of the wireless communication device 130.

When the wireless communication device 130 at the wireless communication system 128 performs communication, the targets of communication are, strictly speaking, the wireless communication tags 72 attached at the toner cartridges 36, 38, 40 and 42. However, in the following descriptions relating to the flowchart of FIG. 8, where there is no need to precisely distinguish a target of communication, the target of communication of the wireless communication device 130 is referred to simply as "the toner cartridges 36, 38, 40 and 42", for the sake of simplicity of description.

In the communication commencement processing, at step 300, it is determined whether or not a multi ID (M) at the wireless communication device 130 side matches a multi ID (M) at the toner cartridge 36 side. If, in step 300, the multi ID (M) of the wireless communication device 130 side matches the multi ID (M) of the toner cartridge 36 side, it is determined that the appropriate toner cartridge 36 has been mounted at the attachment/detachment portion 96 of the cartridge holder 34, and the routine proceeds to step 304. In step 304, the wireless communication device 130 commences communication with the toner cartridge 36. However, if the multi ID (M) of the wireless communication device 130 side does not match the multi ID (M) of the toner cartridge 36 side, the routine proceeds to step 302. In step 302, it is determined if there is no toner cartridge mounted at the attachment/detachment portion 96 of the cartridge holder 34 or if a toner cartridge mounted at the attachment/detachment portion 96 is unsuitable, and predetermined error processing is carried out.

In steps 304 and 306, password checking and system ID checking between the wireless communication device 130 and the toner cartridge 36 are carried out in that order. Here, if it is judged that either the password or the system ID of the toner cartridge 36 side is not proper, it is determined that the toner cartridge mounted in the attachment/detachment portion 96 is not appropriate. The routine proceeds to step 308, and predetermined error processing is carried out. However, if both the password and the system ID of the toner cartridge 36 side are judged to be proper, the routine proceeds to step 310. In step 310, the CPU 144 of the wireless communication device 130 controls the wireless communication tag 72 at the toner cartridge 36 and reads, from the EEPROM 142, process information for one of the photosensitive body drums 20, 22, 24 and 26, such as an exposure amount, static charging amount, development bias and the like, and toner information, such as a charging amount of the toner, type of the toner, storage duration and the like.

In step 312, the CPU 144 at the wireless communication device 130 performs a reading check via the CPU 134 at the toner cartridge 36 to determine whether or not information read from the EEPROM 142 matches information that is written to the EEPROM 142. If the two sets of information match, the routine proceeds to step 314. However, if the two sets of information do not match, the routine returns to step 310, and the process of reading the information is repeated until the information read from the EEPROM 142 matches the information written to the EEPROM 142.

In step 314, the CPU 144 of the wireless communication device 130 transmits initialization information, such as an identification number of the particular laser printer 10, a particular user identification number, a time of commencement of use of the toner cartridge 36, and the like, to the wireless communication tag 72 at the toner cartridge 36. This initialization information is written to the EEPROM 142 of the wireless communication tag 72. In step 316, the CPU 144 at the wireless communication device 130 performs a writing check, via the CPU 134 at the toner cartridge 36, to determine whether or not the transmitted initialization information has been written without errors. If the two sets of information here match, the communication commencement processing for the toner cartridge 36 ends. However, if these two sets of information do not match, the routine returns to step 314, and the information writing process, for writing the initialization information transmitted to the wireless communication tag 72 to the EEPROM 142, is repeated until initial information sent to the wireless communication tag 72 matches the information written to the EEPROM 142.

When the wireless communication system 128 has completed the communication commencement processing for the toner cartridge 36 which accommodates the M toner as described above, essentially the same processing as in the sequence of the communication commencement processing shown in FIG. 8 is performed, in order, for the toner cartridges 38, 40 and 42, which accommodate the Y, K and C toners. When communication commencement processing has been completed between the wireless communication device 130 and all of the toner cartridges 36, 38, 40 and 42, the central control of the laser printer 10 releases internal locking so as to be able to commence image forming operations.

Each time an image is recorded, or at intervals of a predetermined number of image formings, the central control portion outputs information relating to process information, toner consumption amounts and the like, corresponding to each of the toner cartridges 36, 38, 40 and 42, to the CPU 144 via the interface circuit 154 at the wireless communication device 130. The CPU 144 transmits the information from the central control portion to the wireless communication tags 72 of the toner cartridges 36, 38, 40 and 42, and the wireless communication tags 72 write the information from the central control portion to the EEPROMs 142.

Operation of the Embodiment

Next, operation according to the laser printer 10 relating to the present embodiment structured as described above will be explained.

In the wireless communication system 128 of the laser printer 10 relating to the present embodiment, the tag side antennas 82 are supported at the toner cartridges 36, 38, 40 and 42 such that the coil axes TC of the tag side antennas 82 disposed at the toner cartridges 36, 38, 40 and 42 substantially intersect with (are substantially orthogonal to) insertion/removal directions of the toner cartridges 36, 38, 40 and 42 with respect to the attachment/detachment portions 96, 98, 100 and 102. Therefore, there is no need for the tag side antennas 82 to be disposed so as to cover end surface portions of the toner cartridges 36, 38, 40 and 42. Thus, even though the closing cylinder 46, the driven coupling plate 52 and the like are disposed at the end surface portions of the toner cartridges 36, 38, 40 and 42, the wireless communication tags 72 can be easily attached at the toner cartridges 36, 38, 40 and 42 without interfering with these components or the like.

Moreover, in the wireless communication system 128, the main body side antennas 124 are disposed at the cartridge holder 34 such that the coil axes BC of the main body side antennas 124 substantially intersect (are substantially orthogonal to) the insertion/removal directions of the toner cartridges 36, 38, 40 and 42 with respect to the attachment/detachment portions 96, 98, 100 and 102, and such that coil surfaces along coil axis orthogonal directions intersecting (orthogonal to) the coil axes BC face coil surfaces of the tag side antennas 82. Therefore, there is no need to dispose the main body side antennas 124 at portions at the device main body, which face the end surface portions of the toner cartridges 36, 38, 40 and 42. Thus, even though components such as the driving coupling plate and the like are disposed at portions of the drive main body facing the end surface portions of the toner cartridges 36, 38, 40 and 42, the main body side antennas 124 can be easily disposed at the device main body so as not to interfere with these components.

Specifically, in the wireless communication system 128, the two main body side antennas 124 are disposed in the gap between the two toner cartridges 36 and 38 and the gap between the two toner cartridges 40 and 42, respectively. Thus, the main body side antennas 124 can be disposed in spaces which have hitherto rarely been effectively used (dead spaces) while the main body side antennas 124 are disposed sufficiently close to the tag side antennas 82, and can easily be made to face the tag side antennas 82, therefore, the main body side antennas 124 can be efficiently disposed in narrow spaces in the device main body. Further, electric power can be supplied between the wireless communication device 130 and the tag side antennas 82 installed at the toner cartridges 36, 38, 40 and 42 by electromagnetic induction, and electromagnetic communication can be carried out reliably.

Moreover, in the wireless communication system 128, a front face surface portion and a rear surface portion of one main body side antenna 124 face different tag side antennas 82. Therefore, even though the main body side antennas 124 are made smaller, that is, substantially the same size as the tag side antennas 82, one main body side antenna 124 can reliably implement electromagnetic induction and electromagnetic transmission and reception between two of the tag side antennas 82.

Variant Examples of the Embodiment

Figure 9:
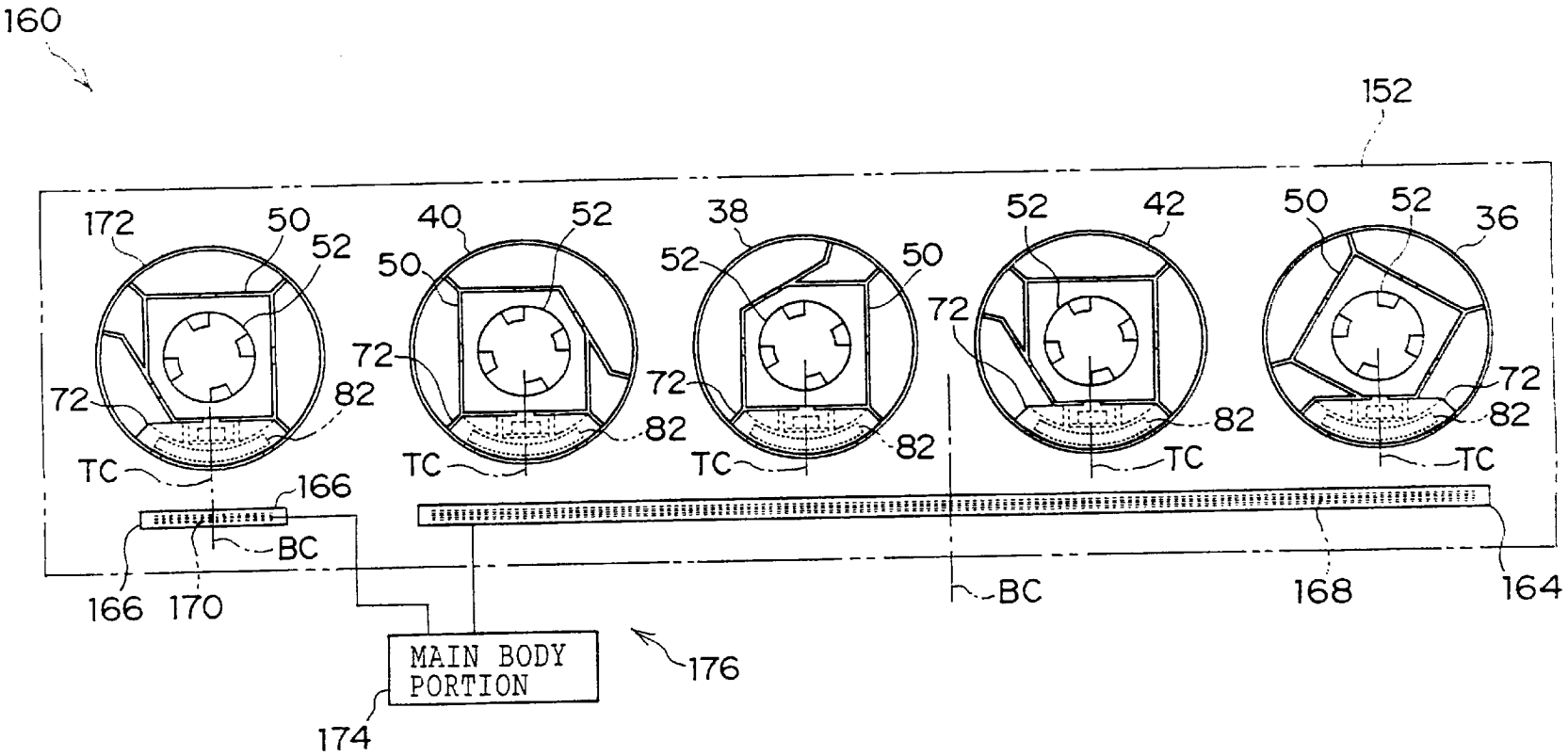
FIG. 9 is an elevational view of toner cartridges and antenna units showing a variant example of the wireless communication system relating to the embodiment of the present invention.
Figure 10:
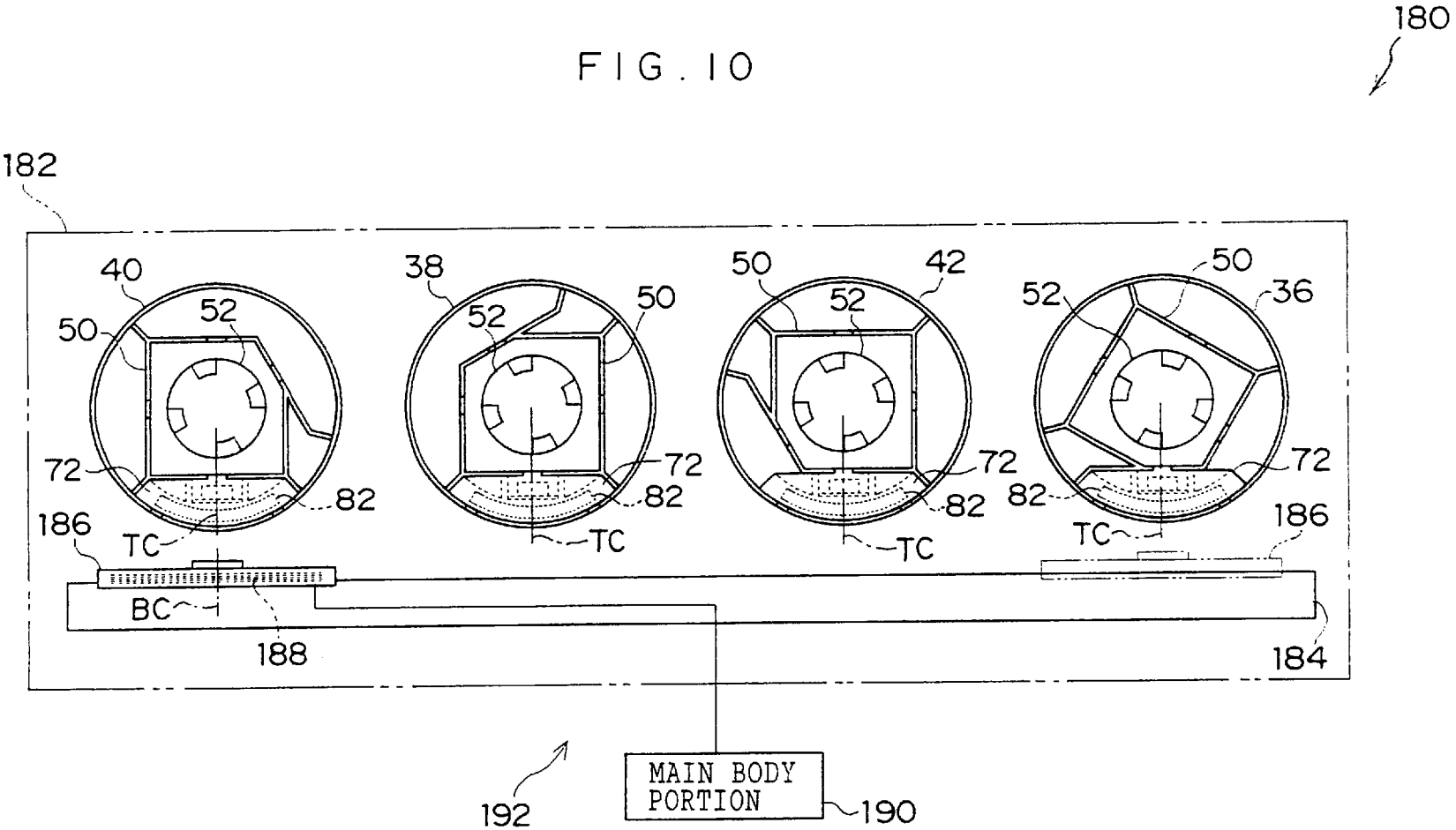
FIG. 10 is an elevational view of toner cartridges and antenna units showing another variant example of the wireless communication system relating to the embodiment of the present invention.

FIGS. 9 and 10 show first and second variant examples of a wireless communication system in a laser printer relating to the present embodiment.

In a laser printer utilizing a wireless communication system 160 shown in FIG. 9, the four toner cartridges 36, 38, 40 and 42 accommodating M toner, Y toner, K toner and C toner, respectively, are detachably mounted at a cartridge holder 162. Also, a toner cartridge 172 accommodating K toner, which is usually consumed in the greatest amounts, is detachably mounted at the cartridge holder 162. Here, because there is a need to preserve mutual interchangeability of the toner cartridge 172 and the toner cartridge 40, the same data is written as the multi ID at each of the EEPROMs 142 of the wireless communication tags 72 attached at the toner cartridges 40 and 172.

As shown in FIG. 9, the five toner cartridges 36, 38, 40, 42 and 172 are mounted at the cartridge holder 162 so as to be arranged substantially in a straight line along a transverse direction of the device. The wireless communication tags 72 are attached at lower end portions of the toner cartridges 36, 38, 40, 42 and 170, so as to face in the same direction (downward). Correspondingly, antenna units 164 and 166, which are each formed in a thin plate shape, are disposed at the cartridge holder 162. A larger main body side antenna 168 is provided in the antenna unit 164. The main body side antenna 168 is structured with a conductive material such as copper wiring or the like wound into a coil shape. A smaller main body side antenna 170 is provided in the antenna unit 166. The main body side antenna 170 is also structured with a conductive material such as copper wiring or the like wound into a coil shape. Coil surfaces of the main body side antennas 168 and 170, which intersect (are orthogonal to) coil axes BC, are substantially parallel to surface directions of the antenna units 164 and 166, respectively.

The main body side antenna 168 of the antenna unit 164 is supported such that the coil surface of the main body side antenna 168 directly faces the coil surfaces of the tag side antennas 82 of the four toner cartridges 36, 38, 40 and 42. The main body side antenna 170 of the antenna unit 166 is supported such that the coil surface of the main body side antenna 170 directly faces the coil surface of the tag side antenna 82 of the toner cartridge 172. Separations between the main body side antenna 168 and the toner cartridges 36, 38, 40 and 42 are substantially the same as a separation between the main body side antenna 170 and the toner cartridge 172. Furthermore, a separation between the main body side antenna 168 and the toner cartridge 172 and separations between the main body side antenna 170 and the toner cartridges 36, 38, 40 and 42 are sufficiently far. Further, electromagnetic output from a wireless communication device 176 and the wireless communication tags 72 are set such that there can be no cross-communication between the main body side antenna 168 and the toner cartridge 172 or between the main body side antenna 170 and the toner cartridges 36, 38, 40 and 42.

In the wireless communication system 160 shown in FIG. 9, the wireless communication device 176 is structured with the main body side antennas 168 and 170 of the two antenna units 164 and 166 connected with a main body portion 174 at a device main body side. The main body portion 174 has basically the same constitution as the main body portion 132 shown in FIG. 7. Therefore, detailed descriptions thereof are not provided here. When communicating to any of the toner cartridges 36, 38, 40 and 42, the wireless communication device 176 carries out electromagnetic communication with the tag side antennas 82 of the toner cartridges 36, 38, 40 and 42, using the main body side antenna 168. When communicating to the toner cartridge 172, the wireless communication device 176 carries out electromagnetic communication with the tag side antenna 82 of the toner cartridge 172 using the smaller main body side antenna 170.

Consequently, even though the toner cartridges 40 and 172, which both accommodate K toner, have the same multi ID, when the main body side antenna 168 communicates with the wireless communication tags 72 of the toner cartridges 36, 38, 40 and 42, crosstalk with the wireless communication tag 72 of the toner cartridge 172 is prevented. Conversely, when the main body side antenna 170 communicates with the wireless communication tag 72 of the toner cartridge 172, crosstalk with the wireless communication tag 72 of the toner cartridge 40 is prevented.

In a laser printer using a wireless communication system 180 shown in FIG. 10, the four toner cartridges 36, 38, 40 and 42 accommodating M toner, Y toner, K toner and C toner, respectively, are detachably mounted at a cartridge holder 182. The toner cartridges 36, 38, 40 and 42 are supported so as to be arranged substantially in a straight line along a transverse direction of the device. The wireless communication tags 72 are attached at lower end portions of the toner cartridges 36, 38, 40 and 42, so as to face in the same direction (downward).

Correspondingly, a guide pedestal 184, which extends substantially in a straight line along the transverse direction of the device, is provided at the cartridge holder 182, so as to face the lower side portions of the toner cartridges 36, 38, 40 and 42. A thin plate-shaped antenna unit 186 is disposed on the guide pedestal 186 and is slideable along the transverse direction. Specifically, the antenna unit 186 is moveable between a position directly facing the toner cartridge 40 as shown by solid lines in FIG. 10, and a position directly facing the toner cartridge 36, as shown by broken lines.

A main body side antenna 188 is provided in the antenna unit 186. The main body side antenna 188 is structured with a conductive material such as copper wiring or the like wound into a coil shape. A coil surface of the main body side antenna 188, which intersects a coil axis BC, is substantially parallel to a surface direction of the antenna unit 186. The size of the main body side antenna 188 along the coil surface is substantially equal to the tag side antennas 82 installed at the wireless communication tags 72.

A driving mechanism (not shown) for driving the antenna unit 186 along the transverse direction is disposed in the guide pedestal 184. The driving mechanism slides the antenna unit 186 to a position directly facing any of the toner cartridges 36, 38, 40 and 42 in accordance with control signals from a main body portion 190 of a wireless communication device 192. Here, the electromagnetic outputs of the wireless communication device 192 and the wireless communication tags 72 are set such that communication is possible only with the wireless communication tag 72 of the one of the toner cartridges 36, 38, 40 and 42 that directly faces the antenna unit 186, and is not possible with the wireless communication tags 72 of the others of the toner cartridges 36, 38, 40 and 42.

In the wireless communication system 190 shown in FIG. 10, the wireless communication device 192 is structured with the main body side antenna 188 of the antenna unit 186 connected with the main body portion 190 at a device main body side. The main body portion 190 has the same structure as the main body portion 132 shown in FIG. 7, except that there is only a single input/output terminal connected with the main body side antenna 188 at a transceiver circuit.

When the wireless communication device 192 is to perform communication with one of the toner cartridges 36, 38, 40 and 42, the antenna unit 186 is moved to a position directly facing a target of communication, which is the one of the toner cartridges 36, 38, 40 and 42, by the driving mechanism in the guide pedestal 184. Then, communication with the wireless communication tag 72 is commenced.

Hence, communication with any of the plurality of toner cartridges 36, 38, 40 and 42 using electromagnetic waves is possible using only the single, compact main body side antenna 188. Moreover, even if one of the toner cartridges 36, 38, 40 and 42 mounted at the cartridge holder 182 has the same multi ID as another of the toner cartridges, communication is performed only with the toner cartridge 36, 38, 40 or 42 that is selected as the target of transmission. The occurrence of crosstalk with the others of the toner cartridges 36, 38, 40 and 42 can be prevented.

In the present embodiment, only cases in which the wireless communication system 128, 160 or 180 relating to the present embodiment is used for communication between the wireless communication device 130, 176 or 192 and the toner cartridges 36, 38, 40 and 42 at the laser printer 10 have been explained. However, besides such toner cartridges 36, 38, 40 and 42, wireless communication tags may be attached at process accessories such as process cartridges which can be mounted at and removed from the device main body of the laser printer 10 and which include an electrophotography light-sensitive body and one or more process accessories, at process accessories such as electrophotography light-sensitive bodies, cleaning units, charging units, discharging units, developing units and the like, and the like. Communication may be performed between the wireless communication device of the device main body and the wireless communication tags, and various kinds of data can be written or read out at these wireless communication tags.

Furthermore, the basic structure of a wireless communication system relating to the present embodiment may be applied to any of various types of image forming device besides laser printers, for example, facsimile devices that perform image forming using an electrophotography process, printers, multifunction devices in which a facsimile device and the like are integrated, and the like. The basic structure of the wireless communication system may also be applied to image forming devices that do not use an electrophotography process, such as inkjet printers, thermal printers and the like, and wireless communication tags may be attached at cartridge accessories to be mounted at and removed from device main bodies thereof, such as ink cartridges, ink ribbon cartridges and the like.

As described above, according to wireless communication systems and image forming devices relating to the present invention, main body side antennas and tag side antennas can be disposed sufficiently close to one another and facing one another without an increase in size of a device, even if the tag side antennas cannot be attached at cartridge accessories so as to cover end surface portions of the cartridge accessories and/or the number of the cartridge accessories mounted at the device main body is large.

What is claimed is:

1. A wireless communication system provided at a device comprising a device main body and a plurality of cartridge accessories insertably and removably mounted at the device main body, the system comprising:

at least one main body side antenna disposed at the device main body; and tag side antennas attached at the cartridge accessories, two of the tag side antennas are disposed sandwiching and facing the one main body side antenna, wherein the tag side antennas are supported by the cartridge accessories such that coil axes of the tag side antennas are substantially perpendicular to a direction of insertion and removal of the cartridge accessories into and from the device main body, and the main body side antenna is supported by the device main body such that a coil axis of the main body side antenna is substantially parallel with at least one of the coil axes of the tag side antennas.

2. The wireless communication system of claim 1, wherein a plurality of the tag side antennas are disposed facing the main body side antenna.

3. The wireless communication system of claim 2, further comprising an antenna selection section which selectively enables communication with any one of the plurality of the tag side antennas.

4. An image forming device comprising:

a device main body in which image forming is carried out;

a plurality of cartridge accessories insertably and removably mounted at the device main body; and a wireless communication system including at least one main body side antenna disposed at the device main body, and tag side antennas attached at the cartridge accessories, two of the tag side antennas are disposed sandwiching and facing the one main body side antenna, wherein the tag side antennas are supported by the cartridge accessories such that coil axes of the tag side antennas are substantially perpendicular to a direction of insertion and removal of the cartridge accessories into and from the device main body, and the main body side antenna is supported by the device main body such that a coil axis of the main body side antenna is substantially parallel with at least one of the coil axes of the tag side antennas.

5. The image forming device of claim 4, wherein, the device main body comprises a photosensitive body at which a static electricity latent image is formed by light, and a developing unit which develops the static electricity latent image formed at the photosensitive body with toner, and the cartridge accessory comprises a toner accommodation container which accommodates toner to be supplied to the developing unit.

6. The image forming device of claim 4, wherein the cartridge accessory comprises:

a photosensitive body at which a static electricity latent image is formed by light;

a developing unit for developing the static electricity latent image formed at the photosensitive body with toner; and a toner accommodation container which accommodates toner to be supplied to the developing unit.

7. A wireless communication system to be used at a device, the device including a device main body, a plurality of cartridge attachment/detachment portions provided at the device main body, and the plurality of cartridge accessories which are respectively inserted at the cartridge attachment/detachment portions and are insertably and removably mounted thereat, the wireless communication system comprising:

wireless communication tags attached at the cartridge accessories and each including a tag side antenna formed with a conductive member in a coil shape, a tag side wireless control section for transmitting and receiving information non-contactingly via the tag side antenna, and an information storage device for reading therefrom and writing thereto information in accordance with the tag side wireless control section; and a wireless communication device disposed at the device main body and including a main body side antenna formed with a conductive member in a coil shape, and a main body side wireless control section for inputting and outputting information to the tag side wireless control section non-contactingly via the main body side antenna and the tag side antenna, wherein the tag side antennas are supported by the cartridge accessories such that coil axes of the tag side antennas are substantially perpendicular to a direction of insertion and removal of the cartridge accessories at the cartridge attachment/detachment portions, and the main body side antenna is disposed at the device main body, such that a coil axis of the main body side antenna is substantially perpendicular to the direction of insertion and removal, wherein the main body side antenna is disposed between a plurality of the cartridge accessories along a direction which is orthogonal to the direction of insertion and removal, and each of a plurality of the tag side antennas that are supported by the plurality of the cartridge accessories faces the main body side antenna, and the main body side antenna faces the tag side antenna.

* * * * *